US008496249B2

(12) United States Patent
Dowling et al.

(10) Patent No.: US 8,496,249 B2
(45) Date of Patent: Jul. 30, 2013

(54) METHOD AND APPARATUS FOR DIVERTING PRINTED PRODUCTS INTO THREE STREAMS

(75) Inventors: John J. Dowling, Rollingsford, NH (US); David Clarke Pollock, Somersworth, NH (US); David Elliot Whitten, Barrington, NH (US)

(73) Assignee: Goss International Americas, Inc., Durham, NH (US)

( * ) Notice: Subject to any disclaimer, the term of this patent is extended or adjusted under 35 U.S.C. 154(b) by 0 days.

(21) Appl. No.: 13/023,105

(22) Filed: Feb. 8, 2011

(65) Prior Publication Data

US 2012/0200026 A1 Aug. 9, 2012

(51) Int. Cl.
*B65H 39/10* (2006.01)
*B65H 5/00* (2006.01)
*B65H 29/58* (2006.01)

(52) U.S. Cl.
CPC ..... *B65H 29/58* (2013.01); *B65H 2301/332* (2013.01)
USPC ..... 271/303; 271/225

(58) Field of Classification Search
USPC ..... 271/303–305, 184, 3.3–3.5, 225
See application file for complete search history.

(56) References Cited

U.S. PATENT DOCUMENTS 4,016,788 A 4/1977 Hardy
4,373,713 A * 2/1983 Loebach ..... 271/303
4,486,015 A 12/1984 Takahashi
4,729,282 A * 3/1988 Kasdorf ..... 83/26
5,009,332 A 4/1991 Sannel et al.
5,064,180 A * 11/1991 Wingate ..... 270/47
5,080,338 A 1/1992 Belanger et al.
5,112,033 A 5/1992 Breton
5,467,976 A 11/1995 Doucet
6,129,352 A 10/2000 Stab
6,158,735 A 12/2000 Cote et al.
6,302,392 B1 10/2001 Schaefer et al.
6,595,518 B2 7/2003 Dobrindt
6,796,552 B2 9/2004 Cote et al.
6,988,729 B2 1/2006 Tamura et al.
2007/0257426 A1 * 11/2007 DeGruchy ..... 271/303
2010/0090397 A1 * 4/2010 Taniguchi ..... 271/303
2010/0122942 A1 5/2010 Harres et al.
2010/0213661 A1 8/2010 Fukazawa et al.

* cited by examiner

*Primary Examiner* — Patrick Cicchino
(74) *Attorney, Agent, or Firm* — Davidson, Davidson & Kappel, LLC

(57) ABSTRACT

A diverter for receiving printed products in a single stream and diverting the printed products into a plurality of streams is provided. The diverter includes a first rotating body rotating about a first axis and including first, second and third circumferential sections positioned around the first axis. Each circumferential section of the first rotating body extends radially a different distance from the first axis. The diverter also includes a second rotating body rotating about a second axis and including first, second and third circumferential sections positioned around the second axis. Each circumferential section of the second rotating body extends radially a different distance from the second axis. The first and second rotating bodies divert the printed products into three separate streams at a diverting area between the first and second axes. The diverter also includes a steeple positioned downstream of the diverting area. A method for diverting printed products in a folder, a printing press, a method for adjusting a diverter and a steeple for a diverter are also provided.

8 Claims, 10 Drawing Sheets

METHOD AND APPARATUS FOR DIVERTING PRINTED PRODUCTS INTO THREE STREAMS

The present invention relates generally to printing presses and more specifically to a diverter for diverting printed products into streams in a printing press folder.

BACKGROUND OF INVENTION

U.S. Pat. No. 4,729,282 discloses a sheet diverter for a pinless folder. A cutter cuts a ribbon into a plurality of signatures and the signatures are successively introduced into a plane of the sheet diverter. The sheet diverter includes an oscillating pair of counter rotating eccentric rolls associated to create linear reciprocation of a nip formed between the eccentric rolls and a triangular diverter wedge deflecting a signature to a selected one of two collation paths.

U.S. Pat. No. 4,373,713 discloses a sheet diverter for diverting cut sheets in a stream along diverging paths. The sheet diverter includes a pair of rotary sheet diverters mounted on parallel driven shafts, each rotary sheet diverter including one raised sheet diverting cam portion and one recessed portion. A tapered guide having a pair of diverging guide surfaces is located between the rotary sheet diverters at a downstream side thereof. A first raised sheet diverting cam portion contacts and diverts a sheet out of the path of the sheets along one of the diverging guide surfaces of the tapered guide into one of the diverging paths while the other raised sheet diverting cam portion has been rotated out of the path of the sheets. The other raised sheet diverting cam portion may then contact and divert a sheet out of the path of the sheets along the other diverging guide surface of the tapered guide into the other diverging path while the first raised sheet diverting cam portion has been rotated out of the path of the sheets.

U.S. Pat. No. 5,112,033 discloses a folder in which printed products are diverted by directly delivering the printed products to two fan assemblies. The fan assemblies are phased such that printed products are alternatingly delivered into a pocket of one of the fan assemblies and into a pocket of the other of the fan assemblies.

U.S. Pat. No. 5,467,976 discloses a diverter mechanism which includes diverting tapes which are diverted from a position along a horizontal transport path to a position along an inclined transport path, and vice versa, by levers which are swivelably mounted on stationary axes.

BRIEF SUMMARY OF THE INVENTION

A diverter for receiving printed products in a single stream and diverting the printed products into a plurality of streams is provided. The diverter includes a first rotating body rotating about a first axis and including first, second and third circumferential sections positioned around the first axis. Each circumferential section of the first rotating body extends radially a different distance from the first axis. The diverter also includes a second rotating body rotating about a second axis and including first, second and third circumferential sections positioned around the second axis. Each circumferential section of the second rotating body extends radially a different distance from the second axis. The diverter also includes a steeple positioned downstream of the diverting area. The first and second rotating bodies divert the printed products into three separate streams at a diverting area between the first and second axes.

A method for diverting printed products in a folder is also provided. The method includes guiding a first printed product from an input stream along a first surface of a steeple to divert the first printed product to a first stream, guiding a second printed product from the input stream along a second surface of the steeple to divert the second printed product to a second stream and guiding a third printed product from the input stream along a third surface of the steeple to divert the third printed product to a third stream.

A printing press is also provided. The printing press includes a plurality of printing units printing images on a web, a folder cutting and folding the web into printed products and a diverter receiving the printed products in one stream and diverting the printed products into three separate streams. The diverter includes a first rotating body and a second rotating body that cooperate at a diverting area to divert the printed products into the three separate streams. Each of the rotating bodies includes circumferential portions of varying radial heights. The diverter also includes a steeple downstream of the diverting area.

A method for adjusting a diverter is also provided. The method includes diverting printed products with the diverter into three separate streams, the diverter including a first rotating body and a second rotating body that cooperate at a diverting area to divert the printed products into the three separate streams, each of the rotating bodies including at least one first lobe having circumferential portions of three different radial heights. The method includes removing the first lobes from the first rotating body and the second rotating body and providing second lobes on each of the rotating bodies, each of the second lobes having circumferential portions of two different radial heights. The method also includes diverting printed products with the diverter into two separate streams.

A steeple for a diverter diverting printed products is provided. The steeple includes a first guide section including a first surface and a second surface. The first surface is arranged and configured for guiding printed products along a first diverting stream. The steeple also includes a second guide section including a third surface and a fourth surface. The third surface is arranged and configured for guiding printed products along a second diverting stream and the second surface and the fourth surface define a slot for guiding printed products along a third diverting stream.

A diverter for receiving printed products in a single stream and diverting the printed products into two streams is also provided. The diverter includes a first rotating body rotating about a first axis and including first and second circumferential sections positioned around the first axis. The circumferential sections of the first rotating body extend radially different distances from the first axis. The diverter also includes a second rotating body rotating about a second axis and including first and second circumferential sections positioned around the second axis. The circumferential sections of the second rotating body extend radially different distances from the second axis. The first and second rotating bodies divert the printed products into two different streams at a diverting area between the first and second axes. The diverter also includes a steeple positioned downstream of the diverting area. The steeple includes a first guiding surface for guiding signatures along a first of the two streams and a second guiding surface for guiding signatures along a second of the two streams. The second guiding surface is arranged and configured as a first plane perpendicular to a second plane passing through the first and second axes.

BRIEF DESCRIPTION OF THE DRAWINGS

The present invention is described below by reference to the following drawings, in which.

DETAILED DESCRIPTION

Figure 1:
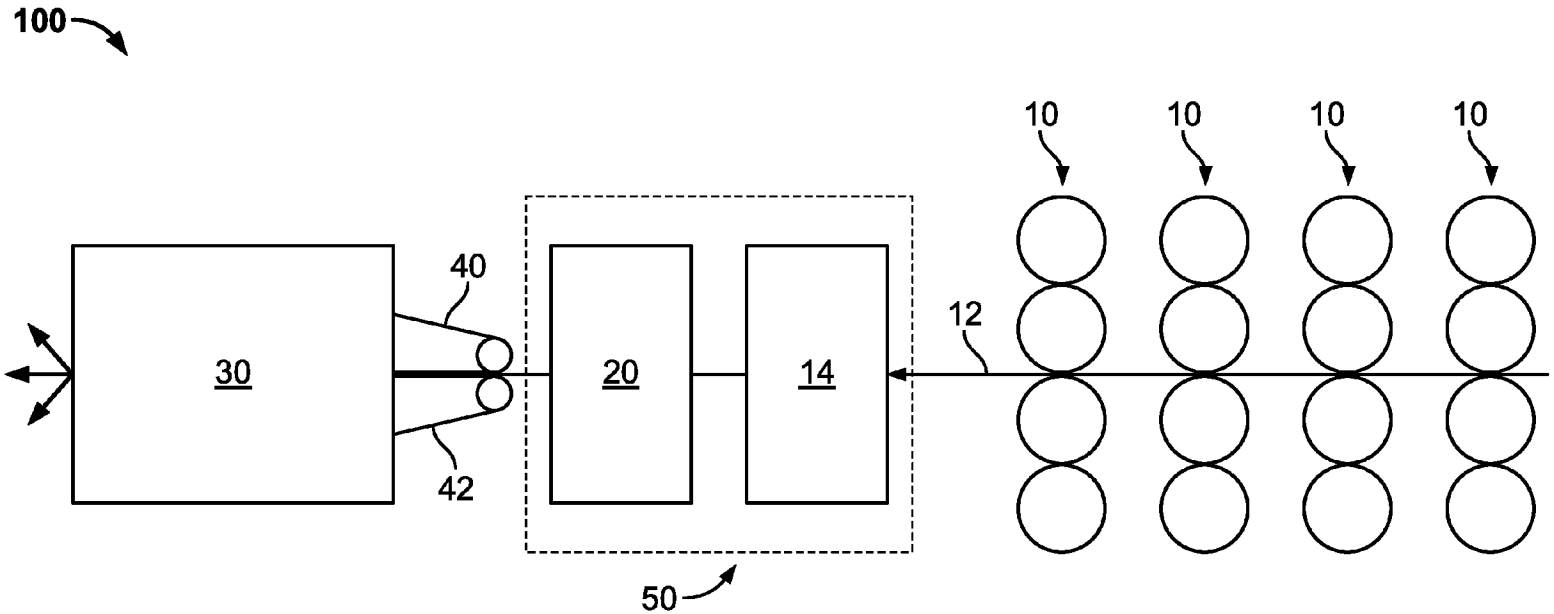
FIG. 1 schematically shows a printing press in accordance with an embodiment of the present invention.

FIG. 1 schematically shows a printing press 100 including a plurality of printing units 10 printing images on a web 12, which is passed into a folder 50. In folder 50, web 12 is cut into signatures by a cutting apparatus 14, which may be folded by a folding apparatus 20. The signatures are then delivered at high speeds by transport tapes 40, 42 to a diverter 30, which diverts the signatures into three separate streams.

Figure 2A:
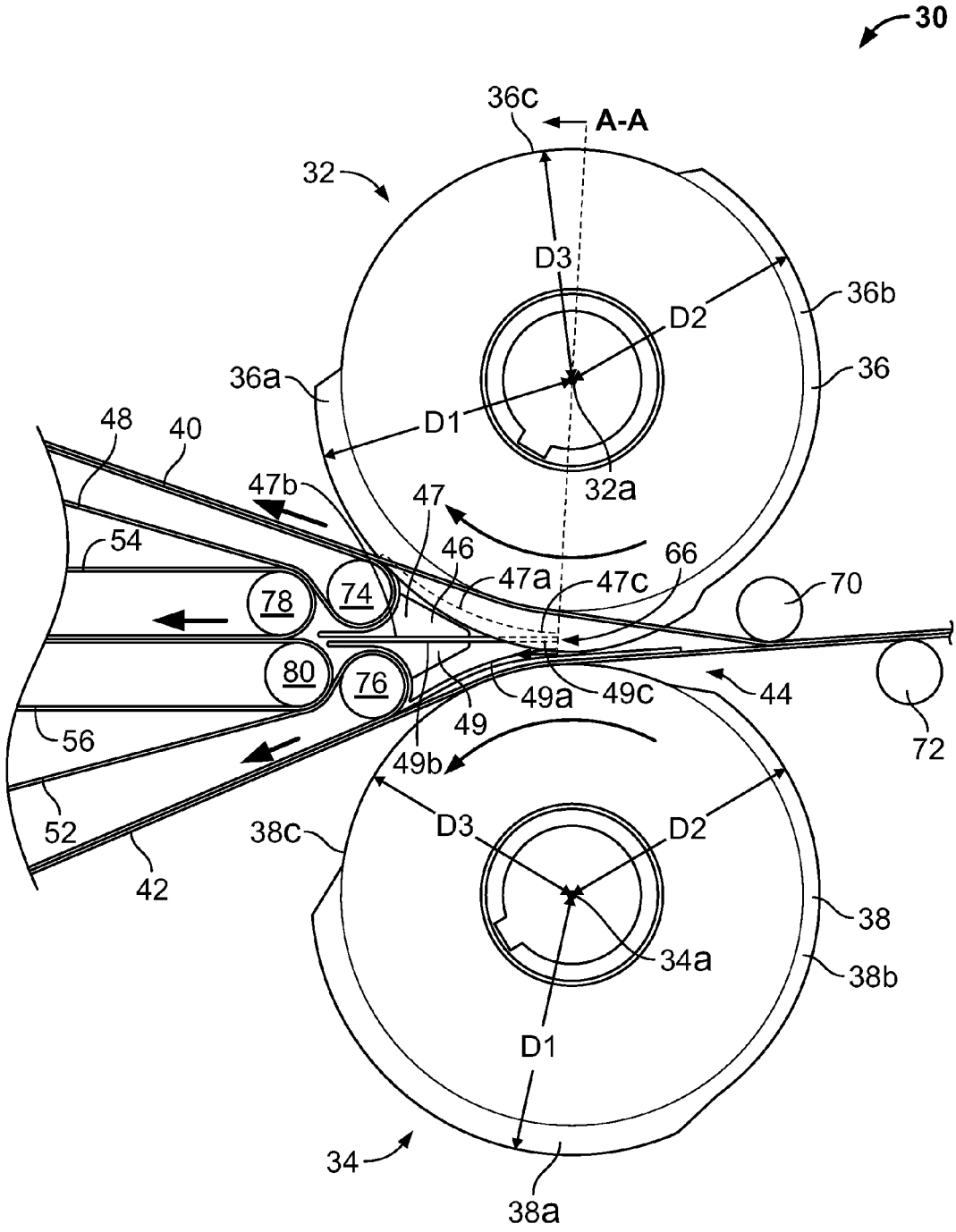
FIG. 2*a* shows a diverter in accordance with an embodiment of the present invention.

FIG. 2*a* schematically shows a more detailed side view of diverter 30. Diverter 30 includes rotating diverter bodies 32, 34 having respective surface lobes 36, 38 for diverting incoming signatures into three separate paths (i.e., triverting). Signatures are transported to rotating diverter bodies 32, 34 by continuous opposing transport tapes 40, 42 along a signature input stream and are output by diverter 30 in three output streams. Transport tapes 40, 42 are guided by respective rollers 70, 72 and tape guiding portions 62 (FIG. 3) of respective diverter bodies 32, 34 so transport tapes 40, 42 diverge from one another as transport tapes 40, 42 approach a diverting area 44 formed directly between respective axes 32*a*, 34*a* of diverter bodies 32, 34. A steeple 46 forming three guiding paths or streams is located on the downstream side of diverting area 44. In the embodiment shown in FIG. 2*a*, steeple 46 is stationary. Steeple 46 may include a first guide section 47 positioned adjacent diverter body 32 and a second guide section 49 positioned adjacent diverter body 34, which together define a slot 66 in steeple 46. Steeple 46 may be formed as two distinct pieces, with guide sections 47, 49 being separate pieces, or may be formed as a single piece, with guide sections 47, 49 being joined at outer edges thereof to define slot 66.

First guide section 47 includes a first outer guiding surface 47*a* adjacent the outer surface of diverter body 32 that guides signatures along a first diverting path between transport tapes 40 and transport tapes 48. Transport tapes 48 are spaced axially on and are guided by a guide roller 74, which may be driven to move transport tapes 48. Second guide section 49 includes a second outer guiding surface 49*a* adjacent the outer surface of diverter body 34 that guides signatures along a second diverting path between transport tapes 42 and transport tapes 52. Transport tapes 52 are spaced axially on and are guided by a guide roller 76, which may be driven to move transport tapes 52. Guide sections 47, 49 may have curved surfaces on sides thereof opposite diverting area 44 that are shaped to receive respective guide rollers 74, 76 and respective tapes 48, 52 therein. Between guide sections 47, 49, a third diverting path is delimited by slot 66 in steeple 46 formed via interior surfaces 47*b*, 49*b* of guide sections 47, 49, respectively. At least one of interior surfaces 47*b*, 49*b* guides signatures along the third diverting path between transport tapes 54, 56. Transport tapes 54, 56 are spaced axially on and are guided by respective guide rollers 78, 80, which may be driven to move transport tapes 54, 56, respectively. Guide rollers 78, 80 may also assist in guiding transport tapes 48, 52, respectively. Guide surfaces 47*a*, 49*a* may be formed with slots therein which portions of respective lobes 36, 38 (i.e., circumferential portions 36*a*, 36*b* and circumferential portions 38*a*, 38*b*) pass through during the rotation of rotating bodies 32, 34. The slots in guide surfaces 47*a*, 49*a* may be aligned with tape guiding portions 62 (FIG. 3) of respective diverter bodies 32, 34.

Each guide 47, 49 section includes a respective triangularly shaped nose 47*c*, 49*c* near diverting area 44 for diverting signatures along the three diverting paths, such that guide sections 47, 49 increase in height as they extend away from diverting area 44. Guide surface 47*a* extends away from nose 47*c* and tapers away from slot 66 so that nose 47*c* may contact signatures near diverting area 44 and direct signatures along the first diverting path. Guide surface 47*a* may extend in a straight path away from nose 47*c* or may be concave and extend along a curved path away from nose 47*c*. Guide surface 49*a* extends away from nose 49*c* and tapers away from slot 66 so that nose 49*c* may contact signatures near diverting area 44 and direct signatures along the second diverting path. Guide surface 49*a* may extend in a straight path away from nose 49*c* or may be concave and extend along a curved path away from nose 49*c*. Slot 66 begins at noses 47*c*, 49*c* and extend to the downstream edges of guide sections 47, 49 so one or both of noses 47*c*, 49 may contact signatures and direct the signatures along the third diverting path.

Lobes 36, 38 each include three portions that extend radially different distances from the center axes 32*a*, 34*a* of respective diverter bodies 32, 34 and thus have different radial heights. With respect to diverter body 32, lobes 36 each include a first circumferential portion 36*a* that extends radially a distance D1 from center axis 32*a*, a second circumferential portion 36*b* that extends radially a distance D2 from center axis 32*a* and a third circumferential portion 36*c* that extends radially a distance D3 from center axis 32*a*. In this embodiment, first circumferential portion 36*a* has the greatest radial height, second circumferential portion 36*b* has the next greatest radial height and third circumferential portion 36*c* has the smallest radial height (i.e., distance D1>distance D2>distance D3). Diverter body 34 is configured in the same manner with three circumferential portions 38*a*, 38*b*, 38*c* of decreasing radial height.

Diverter bodies 32, 34 may be driven by a single motor via gearing or belts, or each motor may be driven by a separate motor. Rollers 74, 76, 78, 80 may be driven by the same motor as diverter bodies 32, 34 via gearing or belts or may be driven by one or more additional motors. A controller is preferably provided for synchronizing the motor or motors of diverter 30 with motors driving printing units 10 (FIG. 1) and motors driving components of folder 50 and if, diverter 30 includes a plurality of motors, synchronizing the motors of diverter 30 with each other. In another embodiment, a single motor may drive all of printing units 10, all the components of folder 50 and all the components of diverter 30.

Figure 2B:
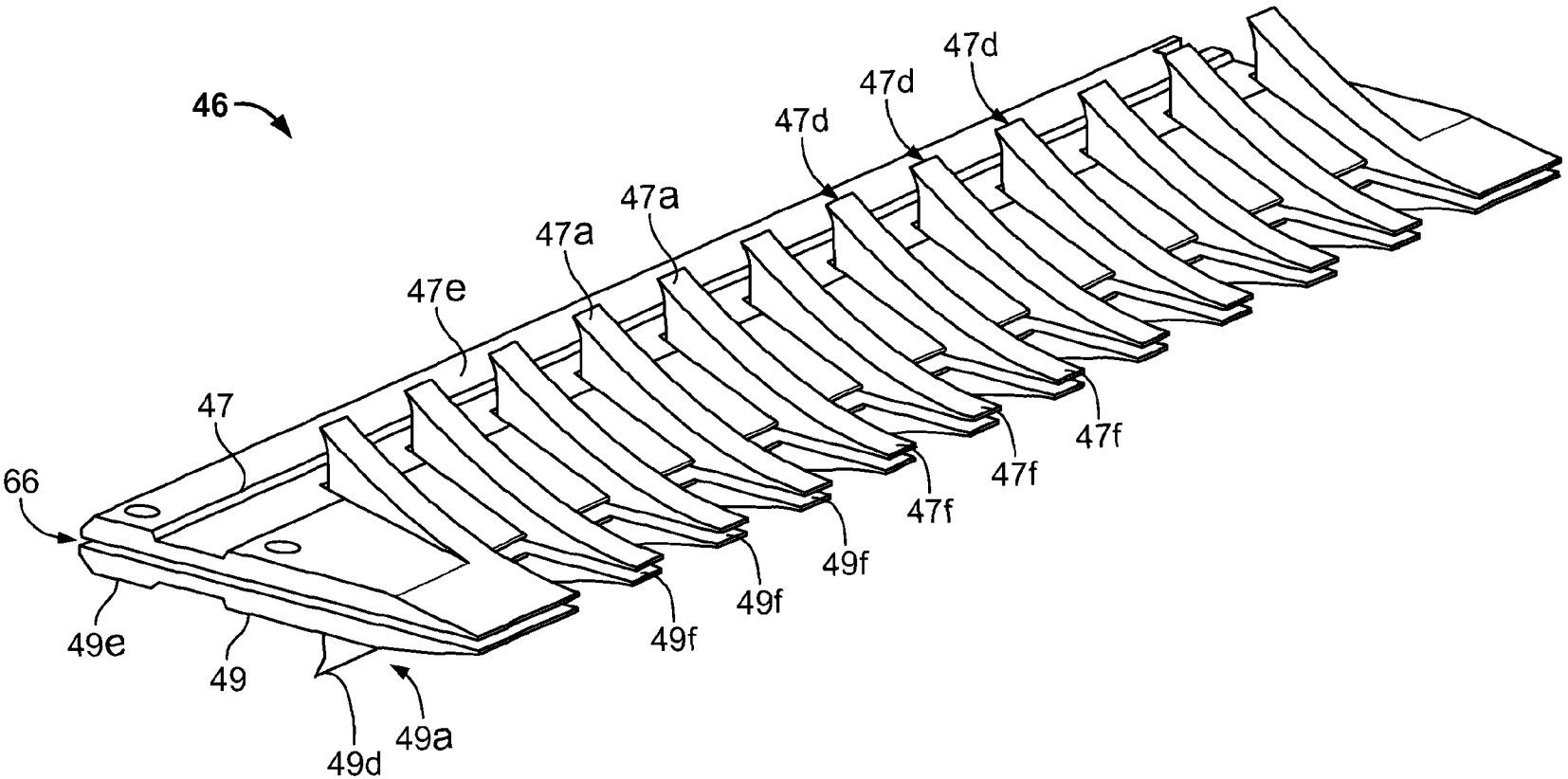
FIG. 2*b* shows a steeple of the diverter shown in FIG. 2*a* in accordance with an embodiment of the present invention.

FIG. 2*b* shows a perspective view of steeple 46 according to an embodiment of the present invention. As discussed above, steeple 46 includes two guide sections 47, 49 defining a slot 66 therebetween. Guide surface 47*a* is formed of a plurality of individual fingers or protrusions 47*d* that extend away from a base portion 47*e*. As shown in FIG. 2*b*, protrusions 47*d* are triangular in shape and are shaped such that guide surfaces 47*a* follow a concave path away from nose portions 47*f* of protrusions 47*d* that form nose 47*c* (FIG. 2*a*). Protrusions 47*d* are axially spaced apart from one another so as to define slots that lobes 36 may pass through during the rotation of diverter body 32. Guide section 49 is configured in the same manner as guide section 47 and is symmetrical to guide section 47 with respect to slot 66. Accordingly, guide section 49 includes a plurality of individual fingers or protrusions 49*d* that are triangular in shape and extend away from a base portion 49*e*. Protrusions 49*d* are also shaped such that guide surfaces 49*a* follow a concave path away from nose portions 49*f* of protrusions 49*d* that form nose 49*c* (FIG. 2*a*). Protrusions 49*d* are axially spaced apart from one another so as to define slots that lobes 38 may pass through during the rotation of diverter body 34.

Figure 3:
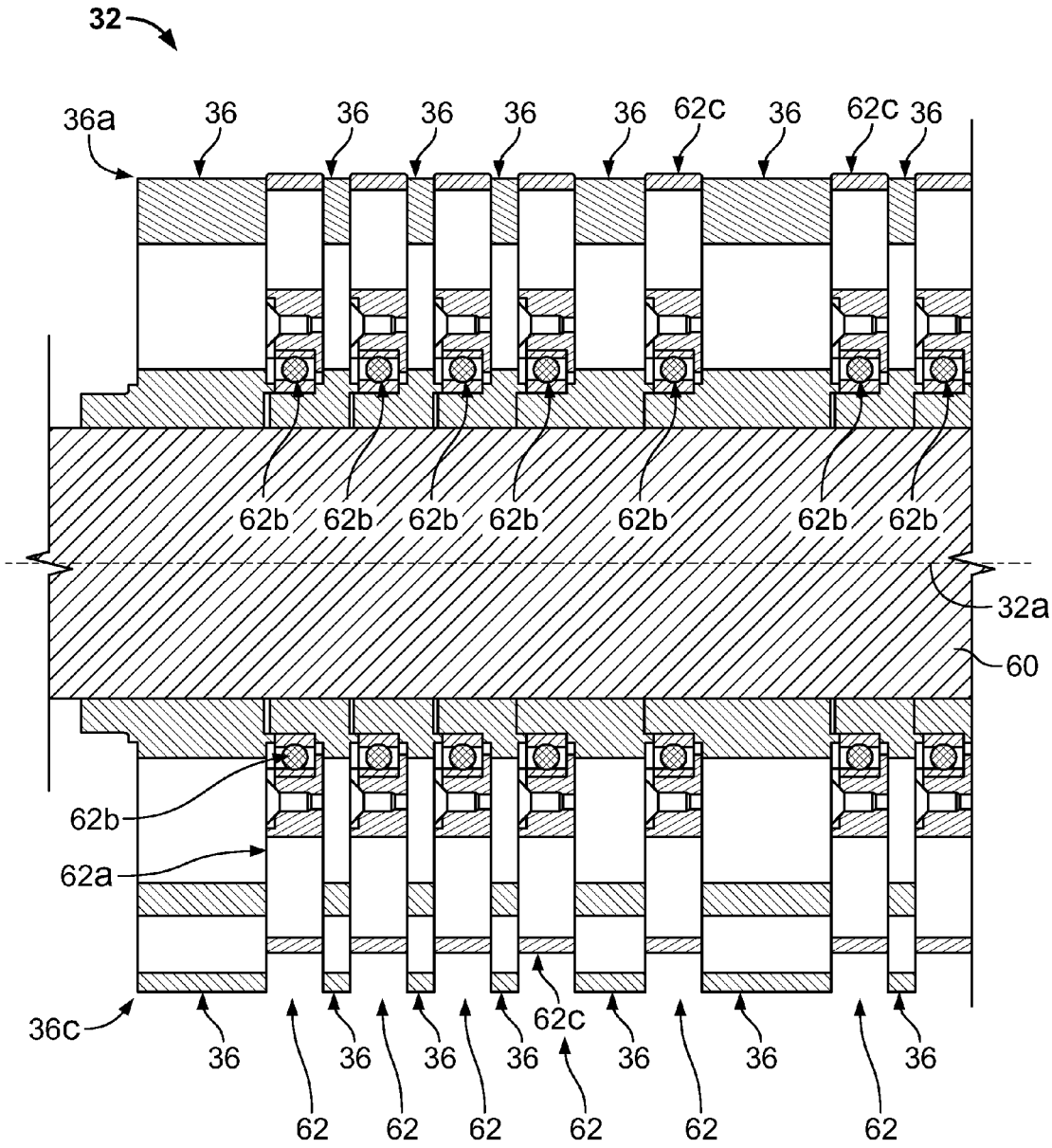
FIG. 3 schematically shows a cross-sectional view of a diverter body along a plane A-A shown in FIG. 2*a;*

FIG. 3 schematically shows a cross-sectional view of diverter body 32 along plane A-A shown in FIG. 2*a*. As shown in FIG. 3, first circumferential portion 36*a* is at the top of diverter body 36 and third circumferential portion 36*c* is at the bottom of diverter body 32. Diverter body 32 is positioned on a shaft 60 rotatable about axis 32*a*. Lobes 36 extend over the circumference of shaft 60 and are axially spaced from one another by tape guiding portions 62. Tape guiding portions 62 include discs 62*a* on bearings 62*b* for supporting tapes such that transport tapes 40 may move on other surfaces 62*c* of tape guiding portions 62 independent of the rotations of shaft 60 and lobes 36.

Figure 4A:
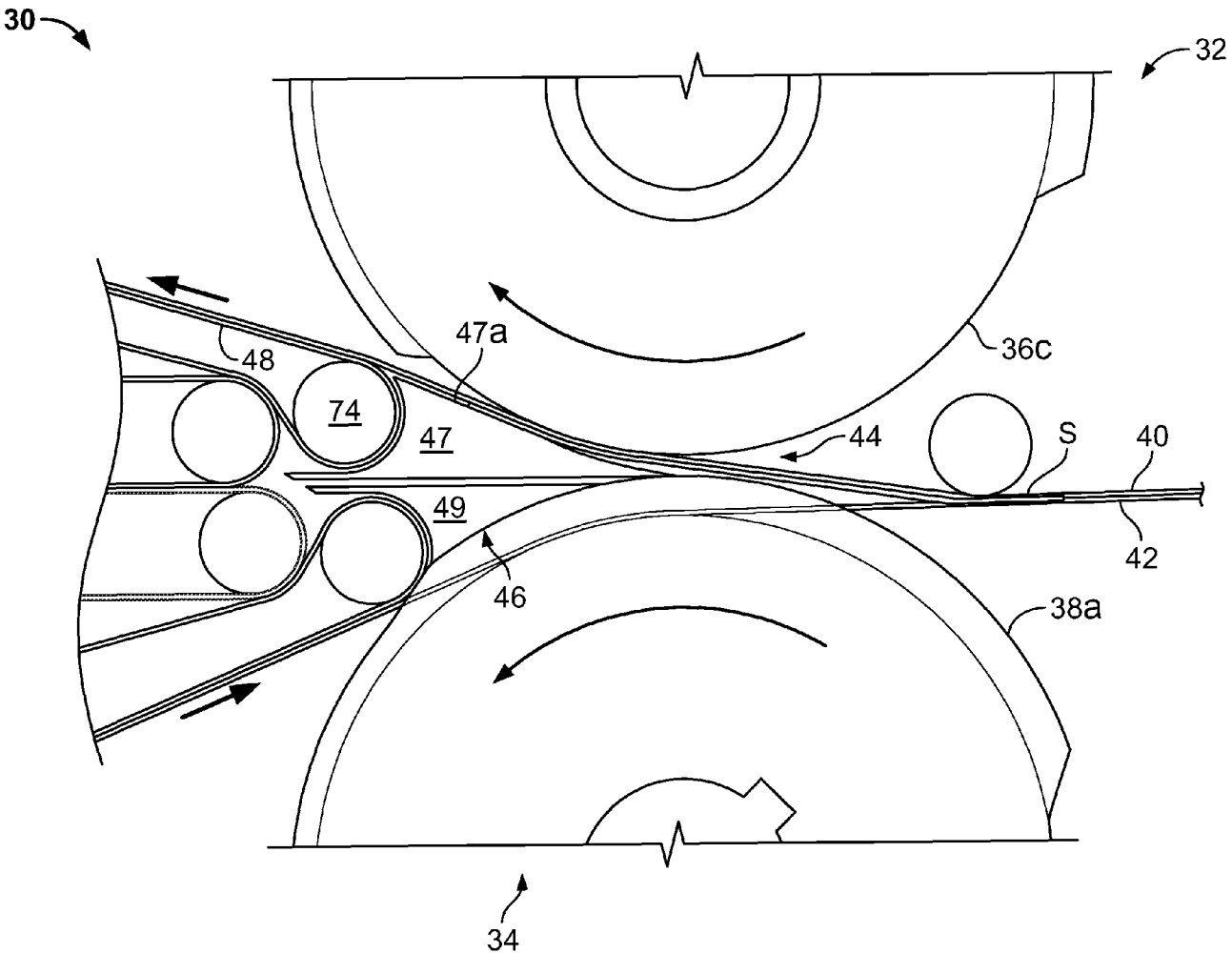
FIGS. 4*a* to 4*c* illustrate how the diverter shown in FIG. 2*a* operates to transport signatures into three streams during each revolution of diverter bodies.
Figure 4B:
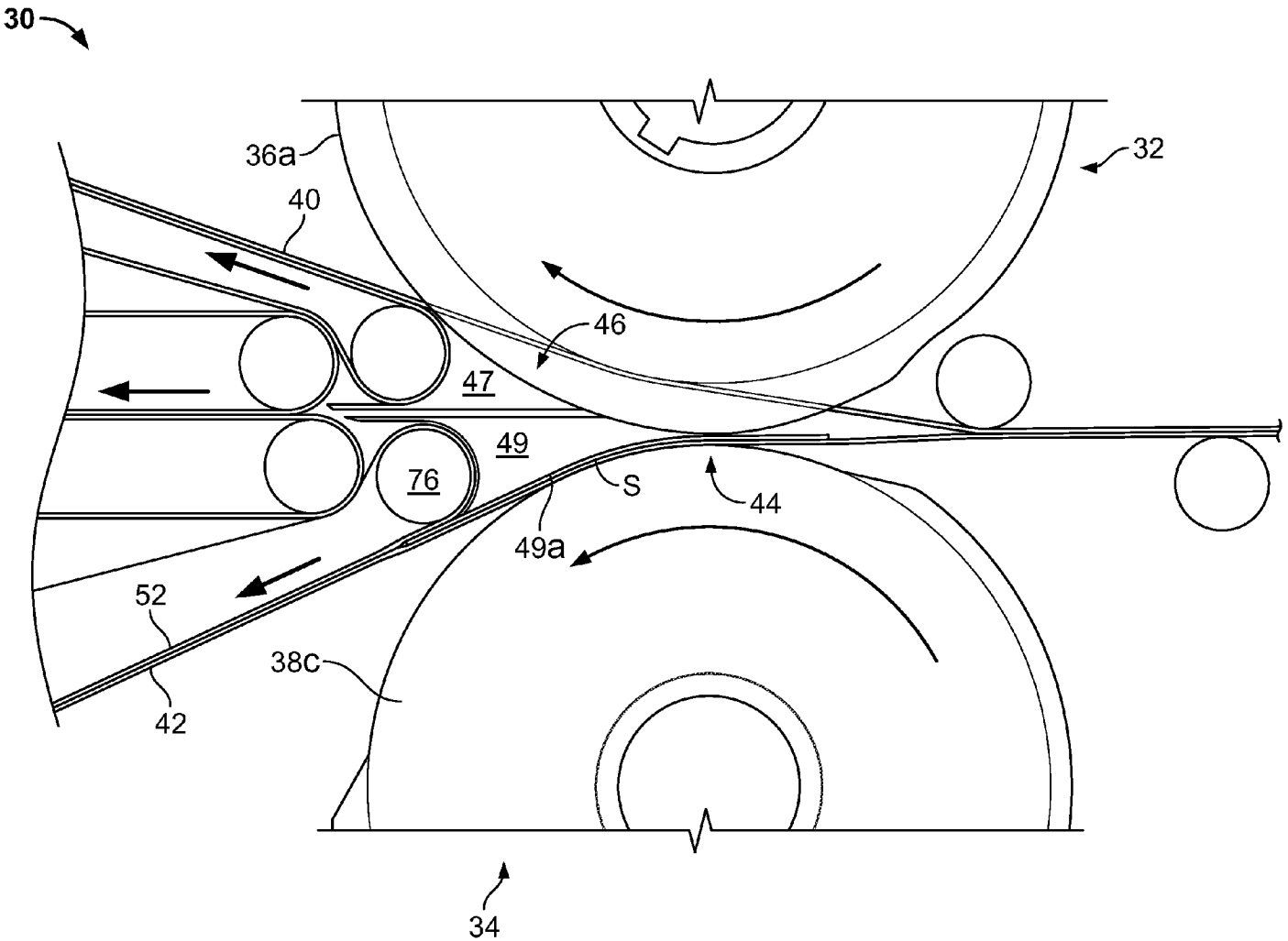
Figure 4C:
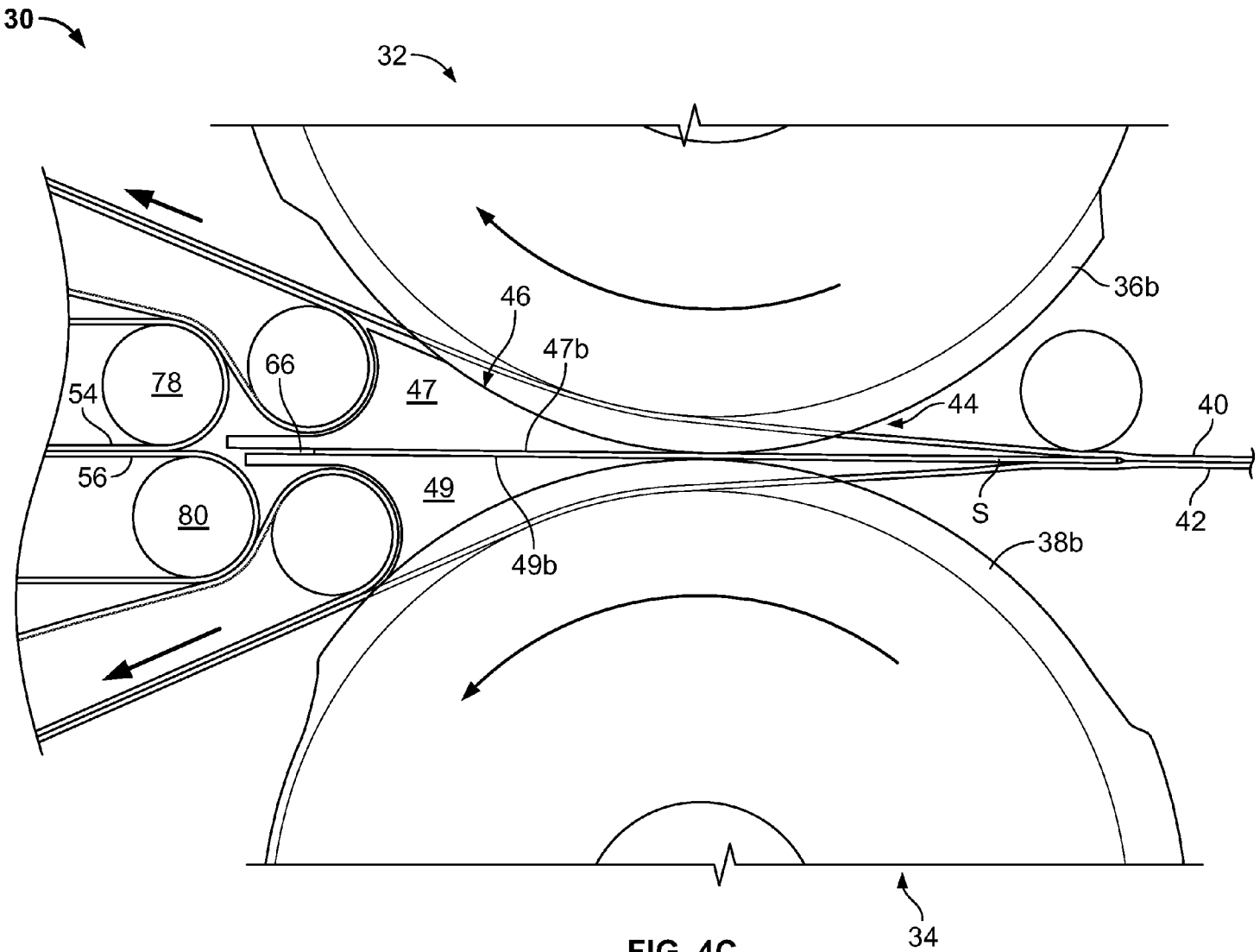

FIGS. 4*a* to 4*c* illustrate how diverter 30 operates to divert signatures delivered by transport tapes 40, 42 in one stream into three separate streams during each revolution of diverter bodies 32, 34.

FIG. 4*a* shows diverting bodies 32, 34 cooperating to guide a signature S along guide surface 47*a* of steeple 46 and transport tape 40 and into the transport stream formed by cooperating transport tapes 40, 48 that merge at roller 74 downstream of guide section 47. Diverter bodies 32, 34 are phased with respect to one another such that third circumferential portions 36*c* are aligned with first circumferential portions 38*a* and pass by diverting area 44 at the same time. Circumferential portions 38*a*, passing through slots formed in guide section 49, force signature S upward and in the embodiment shown in FIG. 4*a*, circumferential portions 36*c* are of a radial height that circumferential portions 36*c* do not contact signature S. Instead, circumferential portions 36*c* are relieved such that circumferential portions 36*c* allow transport tapes 40 to grip signature S along with circumferential portions 38*a* and guide signature forward along guide surface 47*a*. In alternative embodiments, circumferential portions 36*c* may contact and guide signature S.

FIG. 4*b* shows diverting bodies 32, 34 cooperating to guide a signature S along guide surface 49*a* of steeple 46 and transport tape 42 and into the transport stream formed by cooperating transport tapes 42, 52 that merge at roller 76 downstream of guide section 49. Diverter bodies 32, 34 are phased with respect to one another such that first circumferential portions 36*a* are aligned with third circumferential portions 38*c* and pass by diverting area 44 at the same time. Circumferential portions 36*a*, passing through slots formed in guide section 47, force signature S downward and in the embodiment shown in FIG. 4*b*, circumferential portions 38*c* are of a radial height that circumferential portions 38*c* do not contact signature S. Instead, circumferential portions 38*c* are relieved such that circumferential portions 38*c* allow transport tapes 42 to grip signature S along with circumferential portions 36*a* and guide signature forward along guide surface 49*a*. In alternative embodiments, circumferential portions 38*c* may contact and guide signature S.

FIG. 4*c* shows diverting bodies 32, 34 cooperating to guide a signature S between guide sections 47, 49 of steeple 46 and into cooperating transport tapes 54, 56. Diverter bodies 32, 34 are phased with respect to one another such that second circumferential portions 36*b*, 38*b* are aligned with one another and pass by diverting area 44 at the same time. Circumferential portions 38*b* contact signature S and guide signature S along guide surface 49*b*. Signature S may be also guided by guide surface 47*b*, although in some embodiments, only guide surface 49*b* may guide signature S. In the embodiment shown in FIG. 4*c*, circumferential portions 36*b* may also contact signature S to prevent signature S from following the path of guide surface 49*a* so signature S moves forward into slot 66 between guide sections 47, 49. In this embodiment, transport tapes 40, 42 and transport tapes 54, 56 are spaced apart from one another and the length of steeple 46 and the positions of rollers 78, 80 are preferably selected such that transport tapes 54, 56 come into contact with a lead edge of signature S before a trail edge of signature S is released by transport tapes 40, 42. In other embodiments, circumferential portions 36*b* may also contact signature S so that circumferential portions 36*b*, 38*b* grip signature S and move signature S forward into slot 66 between guide sections 47, 49. In embodiments where circumferential portions 36*b*, 38*b* grip signature S, the length of steeple 46 and the positions of rollers 78, 80 are preferably selected such that transport tapes 54, 56 come into contact with a lead edge of signature S before a trail edge of signature S is released by circumferential portions 36*b*, 38*b*. In alternative embodiments, additional transport tapes may be provided along guide surfaces 47*b*, 49*b* to assist in the movement of signature S from diverting area 44 to transport tapes 54, 56 and circumferential portions 36*b*, 38*b* may not grip signature S.

Figure 5:
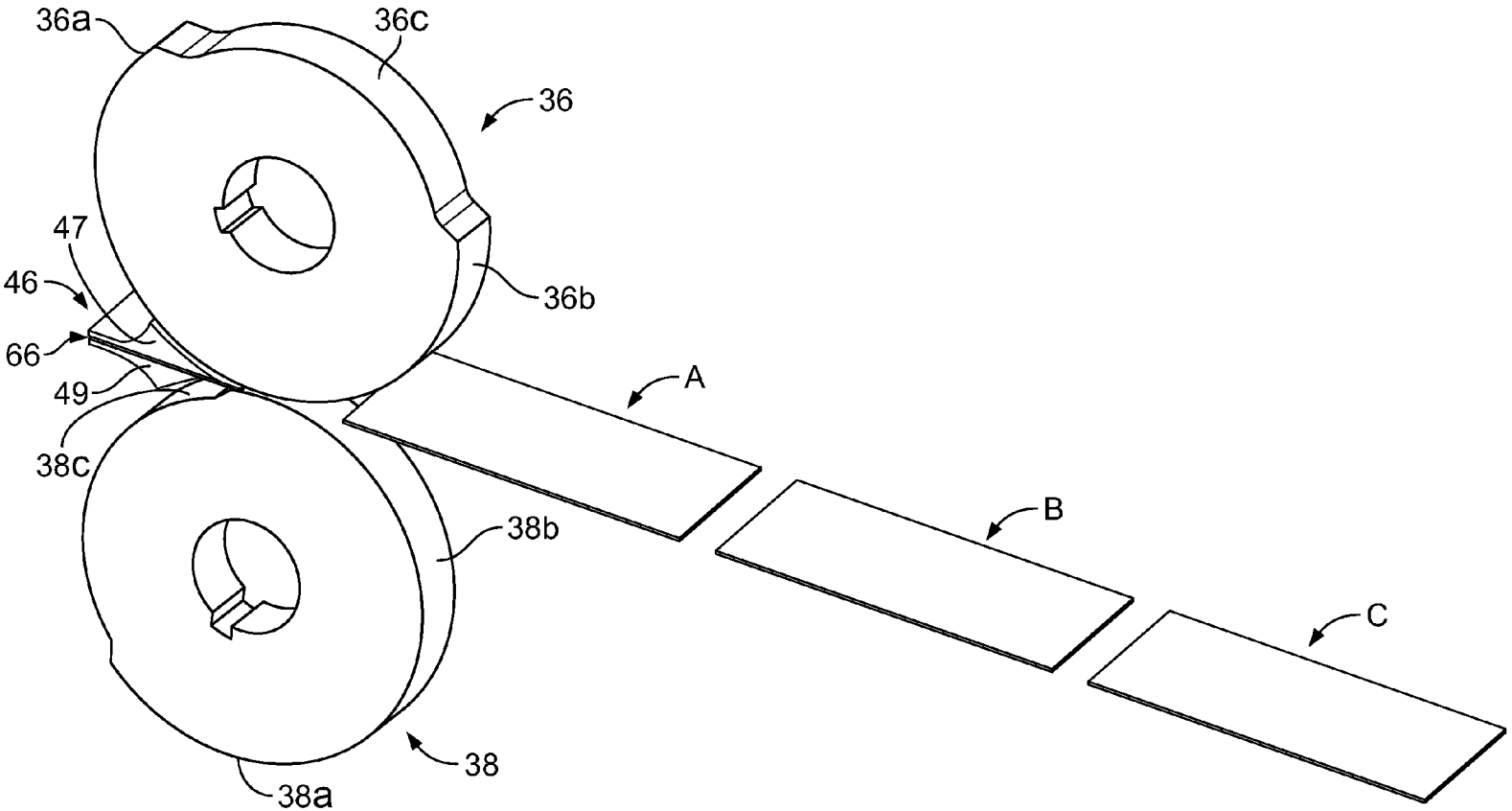
FIG. 5 shows a perspective view schematically showing the diverter shown in FIG. 2*a* diverting signatures into three separate streams.

FIG. 5 shows a perspective view schematically showing one of each lobes 36, 38 operating with steeple 46 to divert signatures A, B and C into three separate streams. Other elements of diverter 30 have been omitted for clarity. Lobes 36, 38 are phased for second circumferential portion 36*b* and second circumferential portion 38*b* to direct signature A into slot 66 between first and second guide sections 47, 49 of steeple 46 (as shown in FIG. 4*c*), for third circumferential portion 36*c* and first circumferential portion 38*a* to direct signature B along the first guide surface 47*a* (as shown in FIG. 4*a*) of first guide section 47 and for first circumferential portion 36*a* and third circumferential portion 38*c* to direct signature C along the first guide surface 49*a* (as shown in FIG. 4*b*) of second guide section 49.

Figure 6A:
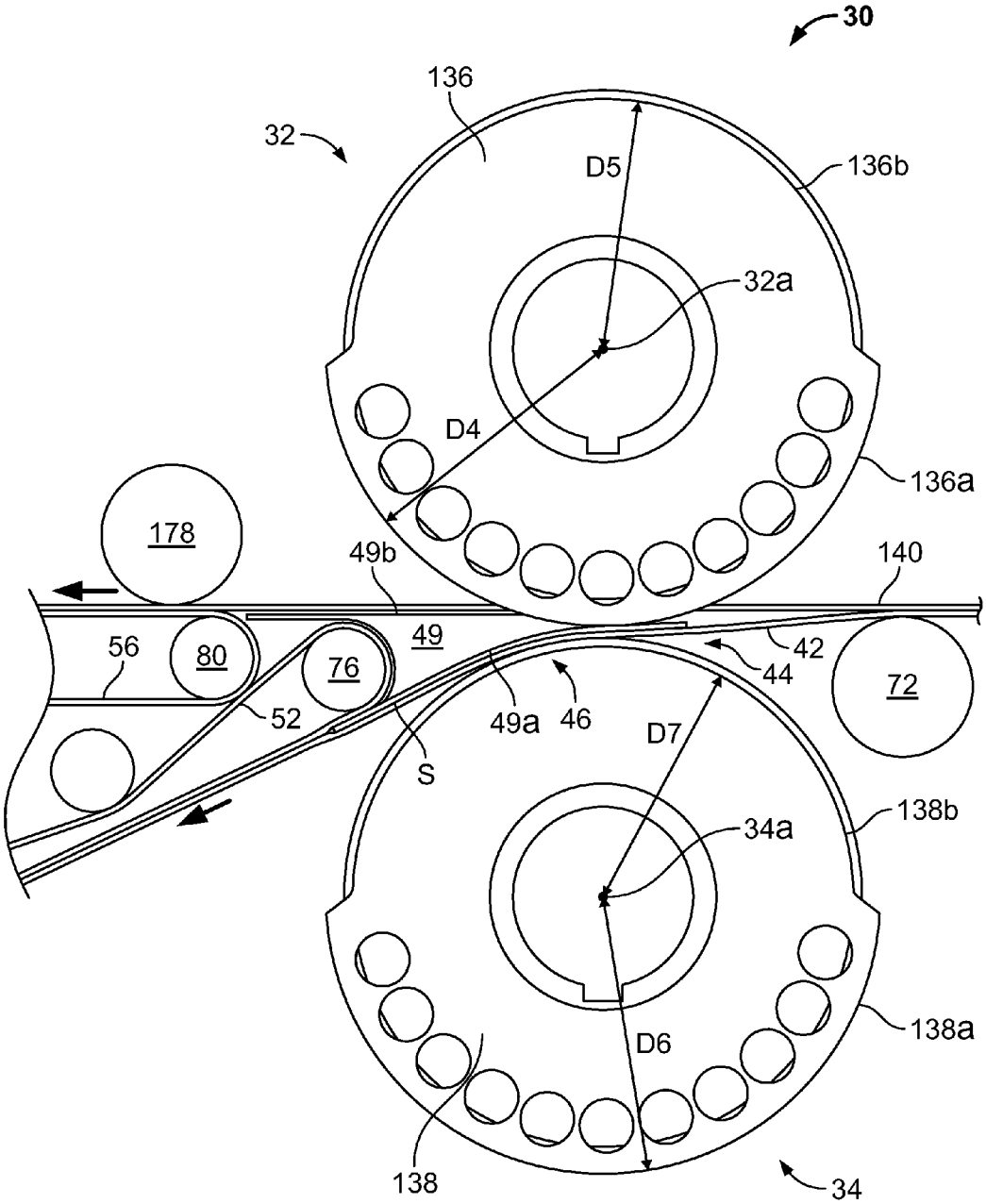
FIGS. 6*a* and 6*b* show the diverter shown in FIG. 2*a* configured to divert signatures into two streams.
Figure 6B:
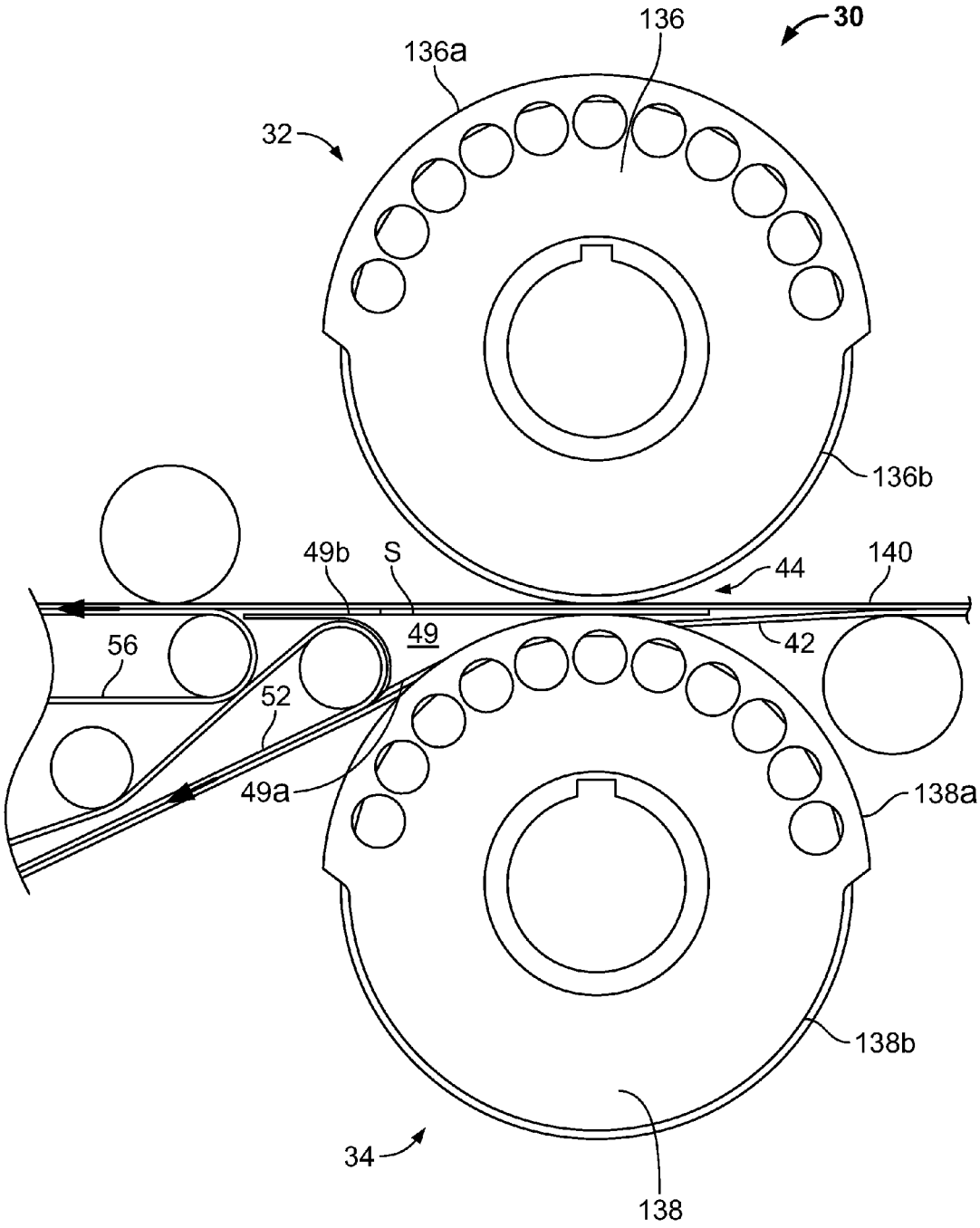

FIGS. 6*a* and 6*b* show diverter 30 configured to divert signatures into two streams. In comparison to FIG. 2*a*, lobes 36, 38 have been removed from diverter bodies 32, 34 and replaced with lobes 136, 138. Also, guide section 47 of steeple 46 may be removed so only guide section 49 remains. Transport tapes 40 may also be removed and replaced with transport tapes 140 that extend parallel to guide surface 49*b* of guide section 49 and may be guided by a guide roller 178. Transport tapes 48, 54 and respective guide rollers 74, 78 may also be removed, while transport tapes 42, 52, 56 and respective guide rollers 72, 76, 80 may be left in place.

Lobes 136, 138 each include two portions that extend radially different distances from the center axes 32*a*, 34*a* of respective diverter bodies 32, 34. With respect to diverter body 32, lobes 136 each include a first circumferential portion 136*a* that extends radially a distance D4 from center axis 32*a* and a second circumferential portion 136*b* that extends radially a distance D5 from center axis 32*a*. In this embodiment, first circumferential portion 136*a* has a greater radial height than second circumferential portion 136*b* (i.e., distance D4>distance D5). With respect to diverter body 34, lobes 138 each include a first circumferential portion 138*a* that extends radially a distance D6 from center axis 34*a* and a second circumferential portion 138*b* that extends radially a distance D7 from center axis 34*a*. In this embodiment, first circumferential portion 138*a* has a greater radial height than second circumferential portion 138*b* (i.e., distance D6>distance D7). However, in contrast to the similar arrangement of the radial heights of circumferential portions 36*a*, 36*b*, 36*c* and circumferential portions 38*a*, 38*b*, 38*c*, respectively, shown in FIG. 2*a*, first circumferential portions 136*a* are not necessarily of the same radial height as first circumferential portions 138*a* and second circumferential portions 136*b* are not necessarily of the same radial height as second circumferential portions 138*b*. First radial portions 136*a* are preferably the same radial height as first radial portions 36*a*, 38*a* in FIG. 2*a* (i.e., distance D4=distance D1), but first radial portions 138*a* are preferably the same radial height as second radial portions 36*b*, 38*b* in FIG. 2*a* (i.e., distance D5=distance D2). Also the radial height of second radial portions 136*b* is preferably less than or equal to the radial height of second radial portions 36*b*, 38*b* in FIG. 2*a* (i.e., distance D6≦distance D2) and the radial height of second radial portions 138 is preferably less than or equal to the radial height of third radial portions 36*c*, 38*c* in FIG. 2*a* (i.e., distance D7≦distance D3). Accordingly, lobes 136, 138 are configured to direct signatures downward along guide surface 49*a* of guide section 49 and parallel along guide surface 49*b* of guide section.

FIG. 6*a* shows lobes 136, 138 cooperating to guide a signature S into a first stream along guide surface 49*a* of steeple 46 and in between transport tapes 42, 52 as transport tapes 42, 52 merge at guide roller 76. Lobes 136, 138 are phased with respect to one another such that first circumferential portions 136*a* are aligned with second circumferential portions 138*b* and pass by diverting area 44 at the same time. Circumferential portions 136*a* force signature S downward and in the embodiment shown in FIG. 6*a*, circumferential portions 138*b* are of a radial height that circumferential portions 138*b* do not contact signature S. Instead, circumferential portions 138*b* are relieved such that circumferential portions 138*b* allow transport tapes 42 to grip signature S along with circumferential portions 136*a* and guide signature forward along guide surface 49*a*. In alternative embodiments, circumferential portions 138*b* may contact and guide signature S.

FIG. 6*b* shows lobes 136, 138 cooperating to guide a signature S in a second stream along guide surface 49*b* of steeple 46 and in between transport tapes 140, 56 as transport tapes 140, 56 merge at guide roller 80. Lobes 136, 138 are phased with respect to one another such that second circumferential portions 136*b* are aligned with first circumferential portions 138*a* and pass by diverting area 44 at the same time. Circumferential portions 138*a* contact signature S and guide signature S along guide surface 49*b*, which is arranged and configured as a plane that is perpendicular to a plane passing through axes 32*a*, 32*b*. In the embodiment shown in FIG. 6*b*, circumferential portions 136*b* are of a radial height that circumferential portions 136*b* do not contact signature S. Instead, circumferential portions 136*b* are relieved such that circumferential portions 136*b* allow transport tapes 140 to grip signature S along with circumferential portions 138*a* and guide signature forward along guide surface 49*a*. In an alternative embodiment, circumferential portions 136*b* also contact signature S so that circumferential portions 136*b*, 138*a* grip signature S and move signature S forward along guide surface 49*b*.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A diverter for receiving printed products in a single stream and diverting the printed products into a plurality of streams comprising:

a first rotating body rotating about a first axis and including first, second and third circumferential sections positioned around the first axis, each circumferential section of the first rotating body extending radially a different distance from the first axis;

a second rotating body rotating about a second axis and including first, second and third circumferential sections positioned around the second axis, each circumferential section of the second rotating body extending radially a different distance from the second axis, the first and second rotating bodies diverting the printed products into three separate streams at a diverting area between the first and second axes; and a steeple positioned downstream of the diverting area;

wherein the first, second and third circumferential sections of the first rotating body extend decreasing radial distances from the first axis and the first, second and third circumferential sections of the second rotating body extend decreasing radial distances from the second axis, the first and second rotating bodies being phased with respect to one another such that the first circumferential section of the first rotating body aligns with the third circumferential section of the second rotating body to guide printed products in a first stream, the second circumferential section of the first rotating body aligns with the second circumferential section of the second rotating body to guide printed products in a second stream and the third circumferential section of the first rotating body aligns with the first circumferential section of the second rotating body to guide printed products in a third stream.

2. The diverter recited in claim 1 wherein the first circumferential section of the first rotating body extends the same radial distance from the first axis as the first circumferential section of the second rotating body extends from the second axis, the second circumferential section of the first rotating body extends the same radial distance from the first axis as the second circumferential section of the second rotating body extends from the second axis and the third circumferential section of the first rotating body extends the same radial distance from the first axis as the third circumferential section of the second rotating body extends from the second axis.

3. The diverter recited in claim 1 wherein during one revolution of the first rotating body about the first axis and one revolution of the second rotating body about the second axis, the first and second rotating bodies guide one printed product into each of the three streams.

4. A printing press comprising:

a plurality of printing units printing images on a web;

a folder, the folder cutting and folding the web into printed products; and the diverter recited in claim 1 receiving the printed products in one stream and diverting the printed products into the three separate streams.

5. The printing press recited in claim 4 wherein the steeple includes a first surface, a second surface and a third surface, each of the first, second and third surfaces guiding printed products along a different one of the three separate streams.

6. The printing press recited in claim 5 wherein the first circumferential section of the first rotating body guides printed products along the first surface of the steeple and the first circumferential section of the second rotating body guides printed products along the second surface of the steeple.

7. The printing press recited in claim 6 wherein the steeple includes a fourth surface, the third surface and the fourth surface defining a slot in the steeple, the second circumferential section of the first rotating body guiding printed products along the third surface of the steeple and through the slot.

8. A method for adjusting the diverter recited in claim 1 comprising:

diverting printed products with diverter into three separate streams, the first rotating body including at least one first lobe having the first, second and third circumferential portions of the first rotating body and the second rotating body including at least one first lobe having the first, second and third circumferential portions of the second rotating body;

removing the first lobes from the first rotating body and the second rotating body;

providing at least one second lobe on each of the first and second rotating bodies, the at least one second lobe of the first rotating body including two circumferential sections extending radially different distances from the first axis, the at least one second lobe of the second rotating body including two circumferential sections extending radially different distances from the second axis; and diverting printed products with the diverter into two separate streams.

* * * * *